US006530367B2

(12) United States Patent
Akiwa et al.

(10) Patent No.: US 6,530,367 B2
(45) Date of Patent: Mar. 11, 2003

(54) ENGINE AIR-OIL SEPARATOR

(75) Inventors: Toshihiro Akiwa, Saitama (JP); Masayuki Takahashi, Saitama (JP); Teruaki Kitano, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/073,340

(22) Filed: Feb. 13, 2002

(65) Prior Publication Data

US 2002/0112710 A1 Aug. 22, 2002

(30) Foreign Application Priority Data

Feb. 19, 2001 (JP) ..... 2001-041948

(51) Int. Cl.[7] ..... F01M 13/04
(52) U.S. Cl. ..... 123/572
(58) Field of Search ..... 123/572, 573, 123/574, 41.86

(56) References Cited

U.S. PATENT DOCUMENTS 2,979,038 A 4/1961 Zubro et al. ..... 121/194
5,239,972 A * 8/1993 Takeyama et al. ..... 123/573
5,617,834 A * 4/1997 Lohr ..... 123/572
6,152,120 A * 11/2000 Julazadeh ..... 123/572
6,279,556 B1 * 8/2001 Busen et al. ..... 123/572

FOREIGN PATENT DOCUMENTS

| | | |
|---|---|---|
| EP | 0 730 086 A1 | 9/1996 |
| EP | 0 744 535 A1 | 11/1996 |
| EP | 1 039 619 A2 | 9/2000 |
| FR | 907 424 | 3/1946 |
| FR | 1 394 810 | 3/1965 |
| JP | 61-40888 | 11/1986 |
| JP | 3-32113 | 3/1991 |
| JP | 10-220215 | 8/1998 |

* cited by examiner

*Primary Examiner*—Marguerite McMahon
(74) *Attorney, Agent, or Firm*—Armstrong, Westerman & Hattori, LLP

(57) ABSTRACT

An engine air-oil separator provided in a head cover for separating oil contents in blow-by gases that are recirculated to an intake system, wherein a centrifugal separation chamber for generating swirl flows in the blow-by gases is formed integrally with the head cover by a rib-like wall protruding inwardly from an internal surface of an external wall of the head cover, whereby since the centrifugal separation chamber can be embedded in the head cover, the space saving can be attained.

15 Claims, 4 Drawing Sheets

ENGINE AIR-OIL SEPARATOR

BACKGROUND OF THE INVENTION

1. Field of the Invention

The present invention relates to an engine air-oil separator provided in a head cover for separating oil contents in blow-by gases that are recirculated to an intake system of the engine.

2. Description of the Related Art

Crankcase ventilation has been implemented to suppress the deterioration of oil within an oil pan of an engine and to suppress the pressure fluctuation within a crankcase due to reciprocating movements of pistons in the engine. Unburned products are contained in breather air (blow-by gases) generated from the interior of the crankcase, and in an automotive engine, these blow-by gases are then recirculated into intake air for re-combustion.

In addition, lubricating oil mists are contained in breather air from the interior of the crankcase, and re-combustion of the breather air containing the lubricating oil mists produces adverse effects for cleaning of exhaust air, and therefore, to cope with this, an air-oil separator is provided in an engine for separating oil contents in the breather air.

An air-oil separator is well known in, for example, Japanese Patent Unexamined Publication No. Hei.10-220215 which is constructed such that a centrifugal separation chamber is attached to an upper surface of a head cover for producing swirl flows in blow-by gases that are recirculated to an intake system of an engine.

According to the related art disclosed in the above publication, however, since the centrifugal separation chamber protrudes upwardly from the upper surface of the head cover, the height of the engine is increased.

SUMMARY OF THE INVENTION

The invention was made with a view to solving the inconvenience in the above related art, and an object of the present invention is to provide an engine air-oil separator which is improved so that the outwardly protruding amount of a cylinder head can be reduced.

With a view to attaining the object, according to a first aspect of the invention, there is provided an engine air-oil separator provided in a head cover (1) for separating oil contents in blow-by gases that are recirculated to an intake system, wherein a centrifugal separation chamber (7) for generating swirl flows in blow-by gases is formed integrally with the head cover by a wall (a circumferential wall 14 in an embodiment) protruding inwardly from an internal surface of an external wall of the head cover. According to this construction, since the centrifugal separation chamber can be embedded inside the head cover, space saving can be promoted.

Further, according to a second aspect of the invention, there is provided an engine air-oil separator as set in the first aspect of the invention, wherein an outer end of said centrifugal separation chamber opens in the external wall of the head cover, and a blow-by gas inlet passageway (a U-shaped groove 29 in the embodiment) communicating with the interior of the centrifugal separation chamber is formed in a joint surface between a lid member (a flange portion 21 in the embodiment) for closing the opening and the head cover by recessing at least an external surface (an attachment seat 16 in the embodiment) of the head cover.

Furthermore, according to a third aspect of the invention, there is provided an air-oil separator as set forth in the second aspect of the invention, wherein a boss portion (31) provided by the side of the inlet passageway in the head cover, the boss portion having provided therein threaded holes (30) in which bolts for fixing the lid member are screwed for attachment therein.

DETAILED DESCRIPTION OF THE PREFERRED EMBODIMENTS

Referring to the appended drawings, the invention will be described in detail below.

Figure 1:
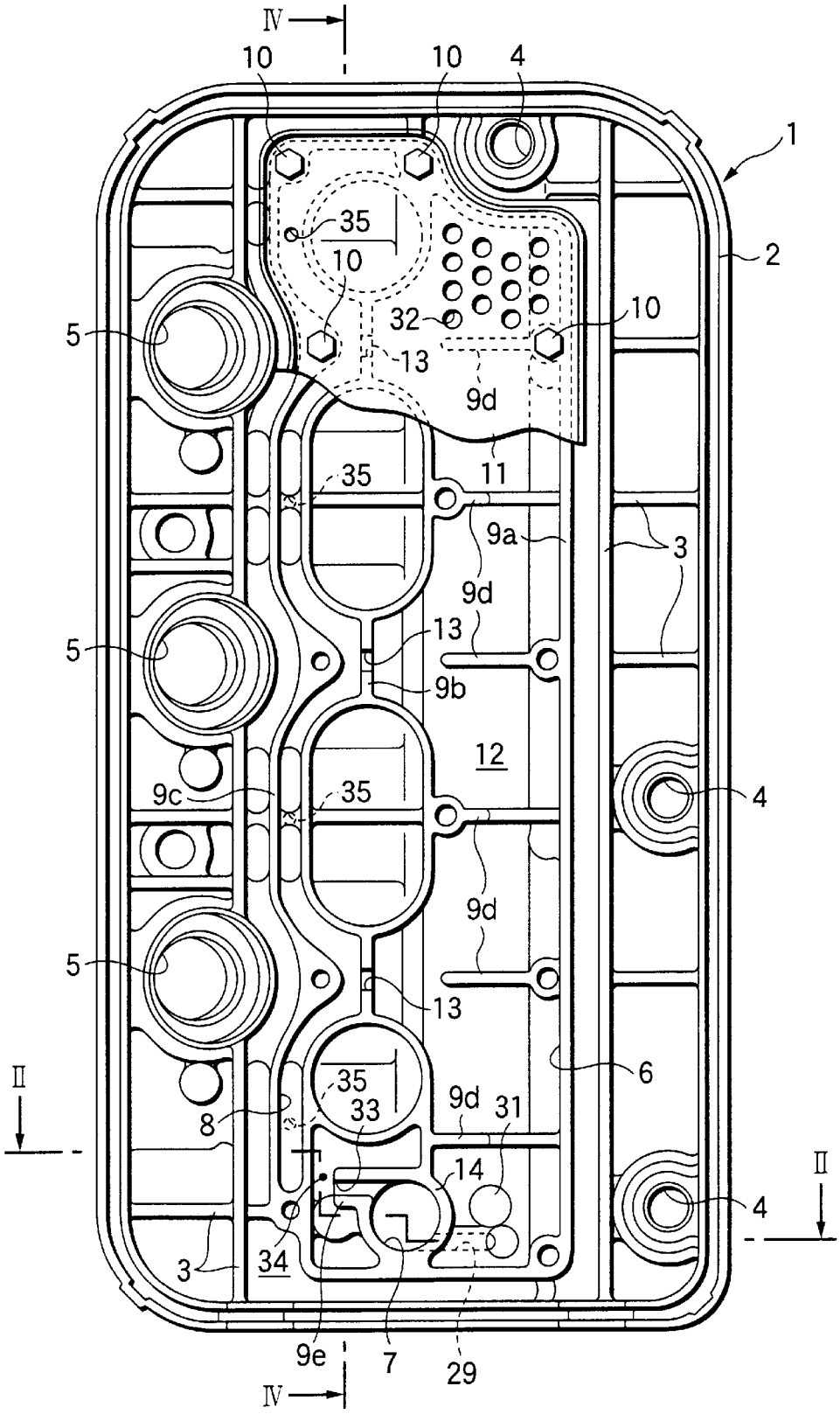
FIG. 1 is a bottom view of an engine head cover to which the invention is applied as viewed from a joint surface between the head cover and a cylinder block.
Figure 2:
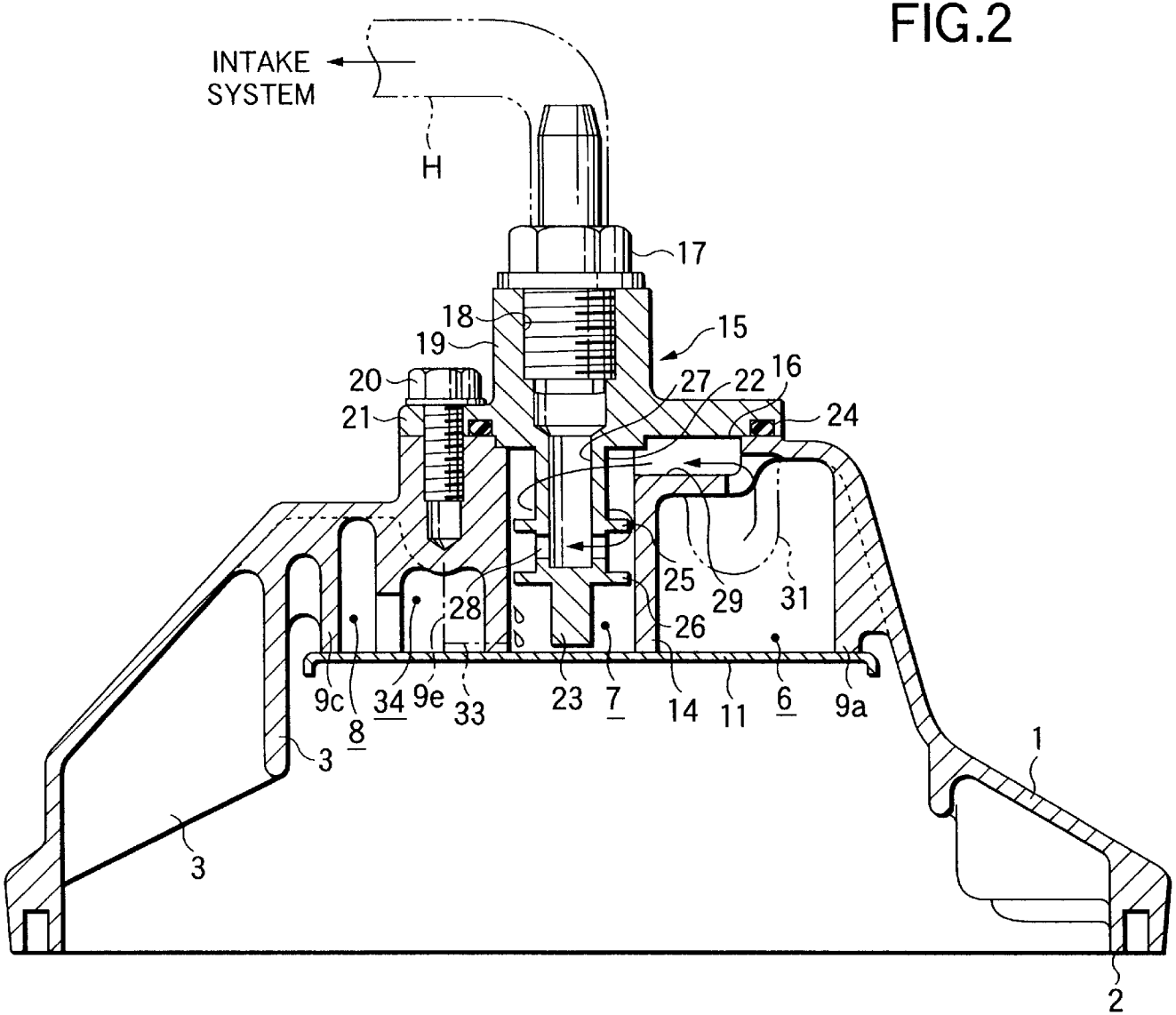
FIG. 2 is a sectional view taken along the line II—II of FIG. 1.

FIGS. 1 and 2 show a head cover of one of cylinder banks of a V-type six-cylinder engine (or an in-line three-cylinder engine). The head cover 1 is die casting molded of, for example, aluminum alloy, and the cross-sectional configuration of the head cover 1 which intersects at right angles with the row of cylinders is substantially trapezoidal. In addition, a joint surface 2 of the head cover to a cylinder head is formed into a substantially rectangular box-like configuration.

The rigidity of the head cover 1 is increased by ribs 3 provided on an internal surface of the head cover 1 so as to extend longitudinally and transversely. In addition, formed in the head cover 1 at suitable locations are through holes 4 in which bolts are passed through for fixing the head cover to the cylinder head and spark plug insertion holes 5.

A labyrinth chamber 6, a centrifugal separation chamber 7 and an oil return passageway 8 are formed inside an upper wall which is part of an external wall of the head cover 1. The labyrinth chamber 6 and the centrifugal separation chamber 7 separate oil contents in blow-by gases filled in the head cover 1, and the oil return passageway 8 returns oil contents separated from blow-by gases to the cylinder head.

The labyrinth chamber 6, the centrifugal separation chamber 7 and the oil return passageway 8 are formed by rib-like baffle walls 9*a* to 9*d* and a common bottom plate 11. The rib-like baffle walls 9*a* to 9*d* are suspended from an internal surface of the upper wall of the head cover 1 so that their lower ends are rest on the same plane. The common bottom plate 11 is made of a metallic plate, is joined to lower edges of the baffle walls 9*a* to 9*d* via a liquid gasket applied thereto and is fixed to the head cover 1 with bolts 10. Thus, embedding the respective chambers 6, 7 in the head cover 1 can attain the promotion of space saving, and molding the respective chambers 6, 7 integrally with the head cover 1 can attain the reduction in the numbers of components and man-hours required for production.

The baffle walls 9*d* extended in a direction intersecting at right angles with a direction in which cylinders are arranged from different sides in an alternate fashion, so that a zig-zagged passageway 12 is formed inside the labyrinth chamber 6.

Figure 4:
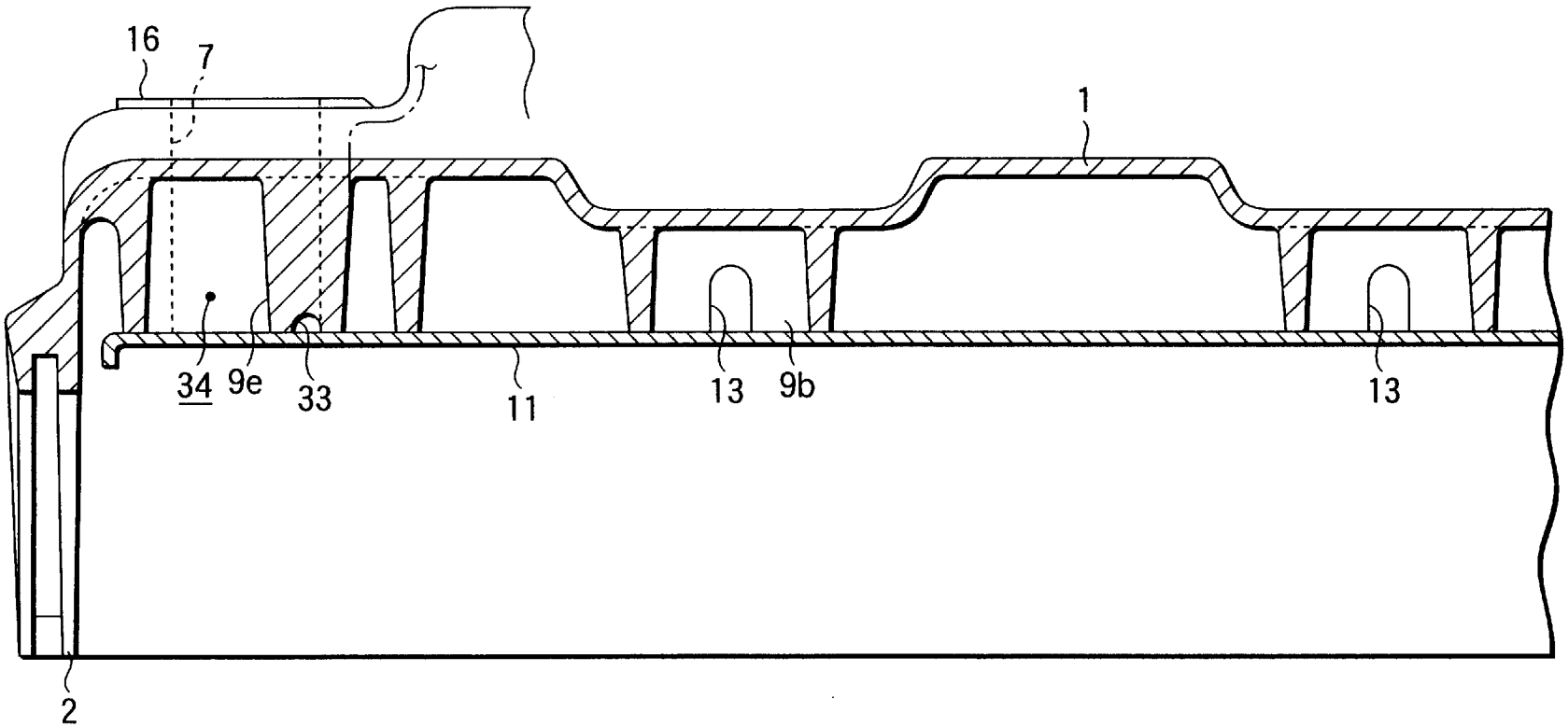
FIG. 4 is a sectional view taken along the line IV—IV of FIG. 1.

The labyrinth chamber 6 and the oil return passageway 8 are both formed adjacent to each other along the cylinder arrangement direction and are communicated with each other via notched portions 13 formed in main points of lower end sides of the baffle wall 9*b* which separates the chamber from the passageway (See FIG. 4).

The centrifugal separation chamber 7 is disposed at a position which is interposed between a terminating end portion of the labyrinth chamber 6 and an end portion of the oil return passageway 8, and a circumferential wall 14 constituting the centrifugal separation chamber 7 is formed into a cylindrical shape. An external end or an upper end of the centrifugal separation chamber 7 is made to open outwardly of the head cover 1, and an attachment seat 16 to which a PCV (positive crankcase ventilation) valve connecting member 15 is joined is formed around the open surface (See FIG. 3).

The PCV valve connecting member 15 includes a boss portion 19, a flange portion 21, a tubular passageway portion 22 (tubular outflow passage body), and a round rod portion 23. The boss portion 19 defines a threaded hole 18 in which a PCV valve 17 is screwed for attachment therein. The flange portion 21 is adapted to be fastened to the attachment seat 16 on the external surface or the upper surface of the head cover 1 with two bolts 20. The tubular passageway portion 22 is formed to suspend in such a manner as to protrude into the centrifugal separation chamber 7 along the center axis thereof. The round rod portion 23 is formed to suspend in such a manner as to protrude from a lower end of the tubular passageway portion 22 deeper into the centrifugal separation chamber 7. The PCV valve connecting member 15 is fixed to the attachment seat 16 via a seal member 24. Since the PCV valve connecting member 15 is adapted to be attached to the attachment seat 16 from the outside of the head cover 1, the attachment work can be implemented easily, and at the same time as this attachment work is carried out, whether or not the bottom plate 11 is attached can be confirmed. In addition, since the boss portion 19 protrudes outwardly or upwardly from the flange portion 21, which functions as a lid member, a PCV valve 17 can have good attachment/detachment properties.

A plurality of (for example, two) disc-like baffle collars (first and second baffle plates) 25, 26 are provided at an axially intermediate position of the tubular passageway portion 22 and a portion where the tubular passageway portion 22 is connected to the round rod portion 23 in such a manner that outer circumferential surfaces of the respective baffle collars 25, 26 face an internal surface of the centrifugal separation chamber 7 with a suitable gap being provided therebetween. A through hole (outflow port) 28 is formed between these two baffle collars 25, 26 which communicate with an outlet passageway 27 formed inside the tubular passageway portion 22. The centrifugal separation chamber 7 is allowed to communicate with an entrance to the PCV valve 17 screwed into the threaded hole 18 of the boss portion 19 via those through hole 28 and the outlet passageway 27 of the tubular passageway portion 22.

As is described above, formed integrally with the PCV valve connecting member 15 are the boss portion 19 for attachment of the PCV valve 17, the flange portion 21 functioning as the lid member for closing an outer or upper end of the opening of the centrifugal separation chamber 7, the tubular passageway portion 22 made to suspend into the centrifugal separation chamber 7, the round rod portion 23 made to suspend from the lower end of the tubular passageway portion 22 further downwardly and the two baffle collars 25, 26 provided in a row on the tubular passageway portion 22, thereby realizing the drastic reduction in the number of components used.

In addition, the PCV valve 17 is directly attached to the centrifugal separation chamber 7, and blow-by gases which are moderately heated in the labyrinth chamber 6 pass around the PCV valve 17. Thus, the temperature of the PCV valve 17 tends to be easily increased, this obviating the necessity of providing a special freezing preventing measures. These aspects contribute to the promotion of miniaturization of the engine and simplification of the construction thereof.

Figure 3:
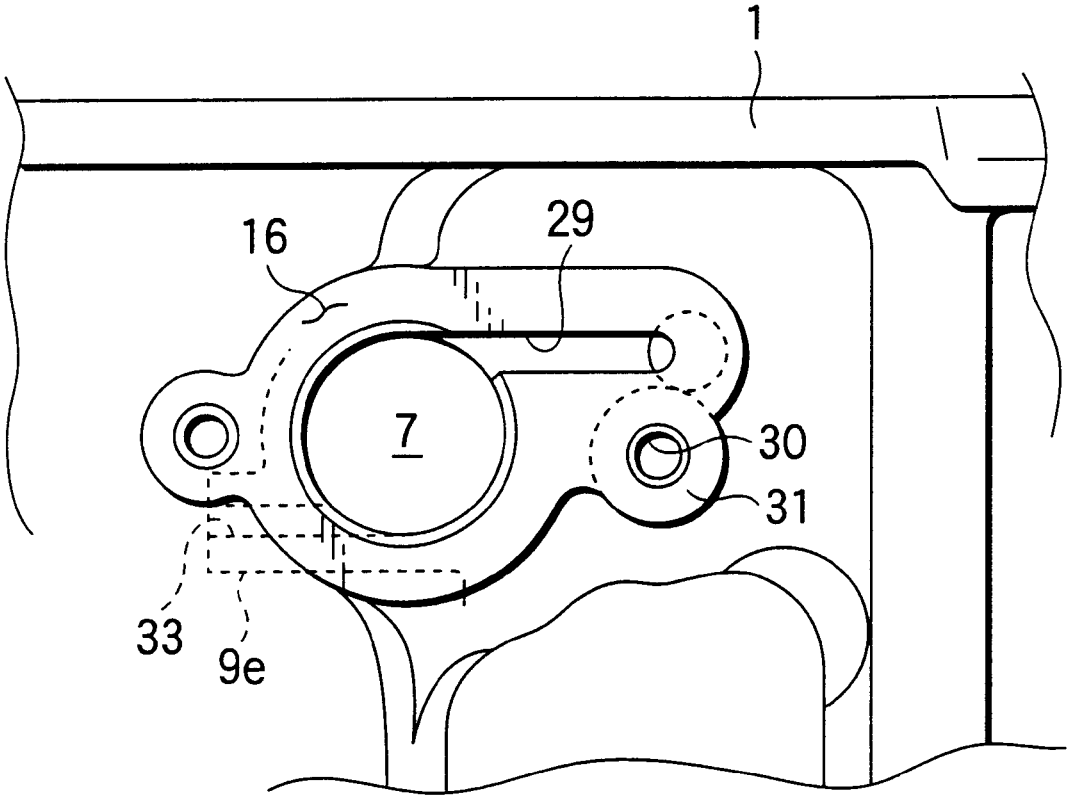
FIG. 3 is a top view of a main part of the engine head cover itself to which the invention is applied.

A U-shaped groove 29 is formed in the attachment seat 16 of the external surface or the upper surface of the head cover 1 which extends in a tangential direction of an inner circumferential surface of the centrifugal separation chamber 7 which is formed into a cylindrical shape (See FIG. 3). This U-shaped groove 29 is allowed to communicate at an end portion thereof with the terminating portion of the labyrinth chamber 6 and an open surface of the U-shaped groove 29 is adapted to be closed with the flange portion 21 of the PCV valve connecting member 15. Thus, the outer end or upper end of the centrifugal chamber 7 is made to open in the upper wall of the head cover and the external surface or upper surface of the attachment seat 16 to which the flange portion 21 for closing the opening is attached is recessed, so as to form the inlet passageway for blow-by gases which extends from the labyrinth chamber 6 to the centrifugal separation chamber 7, whereby he passageway can be formed simply without increasing the numbers of man-hours and components used.

A boss portion 31 is formed on the side of the center side of the centrifugal separation chamber 7 at the end portion of the U-shaped groove 29 in such a manner as to protrude into the terminating end portion of the labyrinth chamber 6, and the boss portion 31 is provided with a threaded hole 30 in which a flange fastening bolt 20 is screwed for attachment therein. Thus, since the flange portion 21 is fastened by the side of the U-shaped groove 29, the sealing quality around the inlet passageway can easily be improved. In addition, the boss 31 acts as a baffle for disturbing a flow of blow-by gases in the terminating end portion of the labyrinth chamber 6, contributing to the improvement of oil contents separating efficiency. Moreover, since the boss portion 31 is provided on the center side of the centrifugal separation chamber 7 in the side space of the U-shaped groove 29, this disposition of the boss portion contributes to the miniaturization of the head cover 1.

With thus structure, blow-by gases filled in the head cover 1 are introduced into the labyrinth chamber 6 from a number of holes 32 (see FIG. 1) opened at one end of the bottom plate 11 in the cylinder arrangement direction. Then, blow-by gases so introduced into the labyrinth chamber 6 flow through the zigzagged passageway 12 within the labyrinth chamber 6. As this occurs, the blow-by gases collide against or contact the respective baffle walls 9*a*, 9*b*, 9*d* which constitute the passageway 12, and oil contents having large specific gravities adhere thereto as a result. The oil contents so separated from the blow-by gases then flow into the oil return passageway 8 via the notched portions 13 formed in the baffle plate 9*b* separating the labyrinth chamber 6 from the oil return passageway 8.

Oil contents which have not been able to be separated in the labyrinth chamber 6 flow into the centrifugal separation chamber 7 via the tangential direction passageway constituted by the U-shaped groove 29 which opens to the terminating end portion of the labyrinth chamber 6, whereby the flow of blow-by gases becomes a swirl flow, and oil contents separated by virtue of centrifugal force adhere to the inner circumferential surface of the centrifugal separation chamber 7 and the outer circumferential surface of the tubular passageway portion 22. Then, when they pass through the gap between the inner circumferential surface of the circumferential wall 14 and the outer or upper baffle collar 25, oil contents are separated from the blow-by gases further. Thus, since the labyrinth chamber 6 which is adapted to separate oil contents first is provided on an upstream side of the centrifugal separation chamber 7, sufficient air-oil separation performance can be obtained.

The blow-by gases from which almost all the oil contents are removed then flow into the PCV valve 17 via the through hole 28 between the two baffle walls 25, 26 and the outlet passageway 27 within the tubular passageway portion 22 and is then sent out to an intake passageway (not shown) via a hose H connected to the PCV valve 17.

On the other hand, oil contents separated in the centrifugal separation chamber 7 flow into a drain chamber 34 formed at the end portion of the oil return passageway 8 via a drain passageway 33 formed in an abutment surface between the baffle wall 9*e* and the bottom slate 11, and thereafter are allowed to drop into the cylinder head from drain holes 35 formed at main portions of the bottom plate 11 in such a manner as to correspond to the oil return passageway 8. In addition, in case the engine is mounted on the vehicle body with the cylinder axis being inclined so that the oil return passageway 8 side becomes lower than the labyrinth chamber 6 side, since the drain holes 35 are allowed to open at the lowest position of the oil return passageway, the efficiency with which oil returns to the cylinder head can be improved.

Here, the drain passageway 33 communicating with the bottom of the centrifugal separation chamber 7 extends in the tangential direction of the inner circumferential surface of the cylinder of the centrifugal separation chamber 7. Therefore, in case there occurs a blow-back from the oil return passageway 8 side when the internal pressure of the oil return passageway 8 becomes higher than the internal pressure of the centrifugal separation chamber 7, since a blow-back flow from the drain passageway 33 becomes a swirl flow, oil contents are separated from the blow-by gases by the action of cyclone effect, and oil contents which have been separated once are prevented from flowing in the reverse direction toward the through hole 28 to mix into blow-by gases which are to be sent to an intake air recirculating passageway by virtue of oil contents capturing action by the baffle collar 26 provided below the through hole 28 in the tubular passageway portion 22 and the round rod portion 23 which suspends further downwardly below the baffle collar 26.

While only the mode has been described heretofore in which the labyrinth chamber 6 and the centrifugal separation chamber 7 are provided in the head cover 1, the locations of the labyrinth chamber 6 and the centrifugal separation chamber 7 are not limited thereto, and they may be provided on a side wall of the head cover 1 as required.

As has been described heretofore, according to the construction of the first aspect of the invention in which the centrifugal separation chamber is formed integrally with the head cover, since the increase in outwardly protruding amount of the head cover can be largely suppressed by embedding the centrifugal separation chamber in the head cover, a great advantage can be provided in the promotion of space saving. Moreover, since the wall with which the centrifugal separation chamber is formed acts as reinforcement walls, the rigidity of the head cover can be attained.

In addition, according to the construction of the second aspect of the invention in which the inlet passageway (the U-shaped groove) communicating with the interior of the centrifugal separation chamber is formed between the lid member (the flange portion) jointed to the external surface of the head cover and the external surface (the attachment seat) of the head cover by recessing the external surface of the head cover, an advantage is provided that the numbers of man hours required to form the passageway and components used can be reduced, and moreover the outwardly protruding amount of the head cover can be reduced further.

Furthermore, according to the construction of the third aspect of the invention in which the boss portion in which the bolt hole for fixing the lid member to the head cover is provided by the side of the passageway, the seal quality around the passageway can be improved, and the construction is more advantageous in that space saving is promoted.

What is claimed is:

1. An engine air-oil separator for separating oil contents in blow-by gases that are recirculated to an intake system, comprising:

a head cover having a wall protruding inwardly from an internal surface of an external wall thereof, said wall defining a centrifugal separation chamber for generating swirl flows in the blow-by gases, so that said centrifugal separation chamber is formed integrally with said head cover.

2. The engine air-oil separator as set forth in claim 1, wherein an outer end of said centrifugal separation chamber defines an opening which opens in said external wall of said head cover, and a blow-by gas inlet passageway communicating with the interior of said centrifugal separation chamber is formed in a joint surface between a lid member for closing said opening and said head cover by recessing at least an external surface of said head cover.

3. The engine air-oil separator as set forth in claim 2, wherein said head cover has a boss portion defining a threaded hole in which a bolt for fixing said lid member is screwed for attachment therein, said boss portion being formed on the side of said inlet passageway in said head cover.

4. The engine air-oil separator as set forth in claim 2, wherein said inlet passageway is formed to extend along a tangential direction of an inner periphery of said inwardly protruded wall of said head cover.

5. The engine air-oil separator as set forth in claim 1, wherein a drain passage for discharging the separated oil components is extended along a tangential direction of an inner periphery of a bottom surface of said centrifugal separation chamber.

6. The engine air-oil separator as set forth in claim 5, further comprising:

a tubular outflow passage body disposed on a center axis of said centrifugal separation chamber and defining an outflow port for blow-by gasses formed at a middle portion in an axial direction thereof;

a first baffle plate disposed on a side close to an opening of said drain passage with respect to said outflow port of said outflow passage body; and a rod portion protruded from a surface of said first baffle plate close to the opening of said drain passage.

7. The engine air-oil separator as set forth in claim 6, further comprising:

an inlet passage having an opening which opens to an outer end side of said centrifugal separation chamber; and a second baffle plate disposed on a side close to said opening of said inlet passage with respect to said outflow port of said outflow passage body, wherein said outflow port penetrates through said outflow passage body in a radial direction thereof.

8. The engine air-oil separator as set forth in claim 6, wherein an outer end of said centrifugal separation chamber defines an opening which opens in said external wall of said head cover, and wherein said outflow passage body and said first baffle plate are formed integral with said a lid member for closing said opening of said centrifugal separation chamber.

9. The engine air-oil separator as set forth in claim 7, wherein an outer end of said centrifugal separation chamber defines an opening which opens in said external wall of said head cover, and wherein said outflow passage body and said first and second baffle plates are formed integral with said a lid member for closing said opening of said centrifugal separation chamber.

10. The engine air-oil separator as set forth in claim 1, further comprising:

a plate abutted against an inner edge of said inwardly protruded wall of said head cover, said plate forming a labyrinth chamber in cooperation with said inwardly protruded wall;

wherein a bottom wall of said centrifugal separation chamber is formed by a part of said plate.

11. The engine air-oil separator as set forth in claim 10, further comprising:

a lid member detachably located in an external wall of said head cover and defining an outer wall of said centrifugal separation chamber.

12. The engine air-oil separator as set forth in claim 11, wherein said head cover has a boss portion defining a threaded hole in which a bolt for fixing said lid member to said head cover is screwed for attachment therein, said boss portion being protruded within said labyrinth camber.

13. The engine air-oil separator as set forth in claim 1, further comprising:

a plate abutted against an inner edge of said inwardly protruded wall of said head cover, said plate forming a labyrinth chamber in cooperation with said inwardly protruded wall, wherein an outlet side of said labyrinth chamber and an inlet side of said centrifugal separation chamber communicates with each other.

14. The engine air-oil separator as set forth in claim 13, wherein said inwardly protruded wall defining said centrifugal separation chamber at least partially defines said labyrinth chamber.

15. The engine air-oil separator as set forth in claim 1, further comprising:

a PCV valve connecting member attached to said external wall of said head cover, said PCV valve connecting member including:

a boss portion to which a PCV valve is attached;

a flange portion radially extending from said boss portion of said PCV valve connecting member, for covering an opening of said centrifugal separation chamber;

a tubular passageway portion axially extending from said boss portion of said PCV valve connecting member along a center axis thereof to protrude into said centrifugal separation chamber;

a round rod portion axially extending from said tubular passageway portion; and a disc-like baffle collar formed at an outer periphery of said tubular passageway portion in such a manner that an outer circumferential surface of said baffle collar faces an internal surface of said inwardly protruded wall with a predetermined gap, wherein said boss portion, said flange portion, said tubular passageway portion, said round rod portion and said disc-like baffle collar of said PCV valve connecting member are formed by a single member.

* * * * *